US005451979A

United States Patent [19]

Levac

[11] Patent Number: 5,451,979

[45] Date of Patent: Sep. 19, 1995

[54] DISPLAY DRIVER WITH DUTY CYCLE CONTROL

[75] Inventor: Ronald A. Levac, Hartland, Wis.

[73] Assignee: Adaptive Micro Systems, Inc., Milwaukee, Wis.

[21] Appl. No.: 147,366

[22] Filed: Nov. 4, 1993

[51] Int. Cl.[6] ..... G09G 3/00

[52] U.S. Cl. ..... 345/82; 345/212

[58] Field of Search ..... 345/82, 83, 147, 148, 345/76, 3, 211, 212, 213

[56] References Cited

U.S. PATENT DOCUMENTS

| | | | |
|---|---|---|---|
| 4,441,106 | 4/1984 | Jackson | 345/82 |
| 4,514,727 | 4/1985 | Van Antwerp | 345/148 |
| 4,642,524 | 2/1987 | Eaton et al. | 345/76 |
| 4,887,074 | 12/1989 | Simon et al. | 345/82 |
| 4,897,639 | 1/1990 | Kanayama | 345/82 |
| 5,184,114 | 2/1993 | Brown | 345/83 |
| 5,218,352 | 6/1993 | Endoh et al. | 345/211 |
| 5,247,286 | 9/1993 | Ishikawa | 345/3 |
| 5,278,542 | 1/1994 | Smith et al. | 345/148 |

*Primary Examiner*—Richard A. Hjerpe
*Assistant Examiner*—Steven J. Saras
*Attorney, Agent, or Firm*—Quarles & Brady

[57] ABSTRACT

A display sign includes a matrix of LED lights which are energized from an unregulated power supply during periodic duty cycles. The duty cycles are adjusted by a programmed microprocessor such that the power supply is not overloaded when a large number of LEDs are energized, and such that excessive power is not applied to the LEDs when a small number of LEDs are energized and the power supply voltage increases.

7 Claims, 3 Drawing Sheets

FIG. 2A
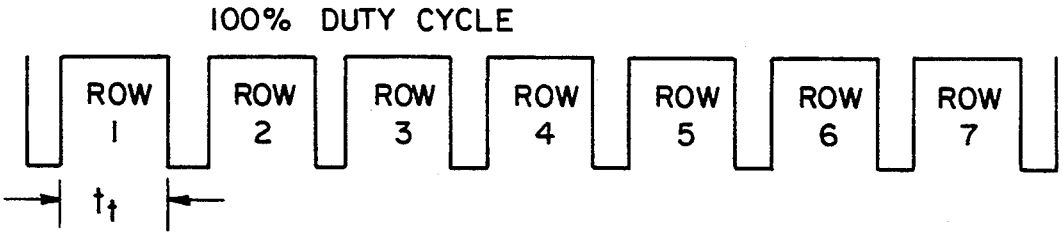
FIG. 2B
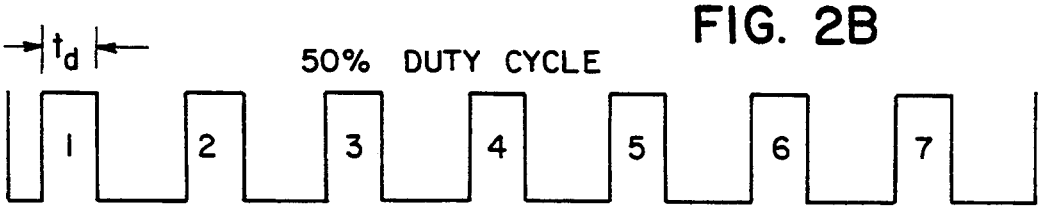
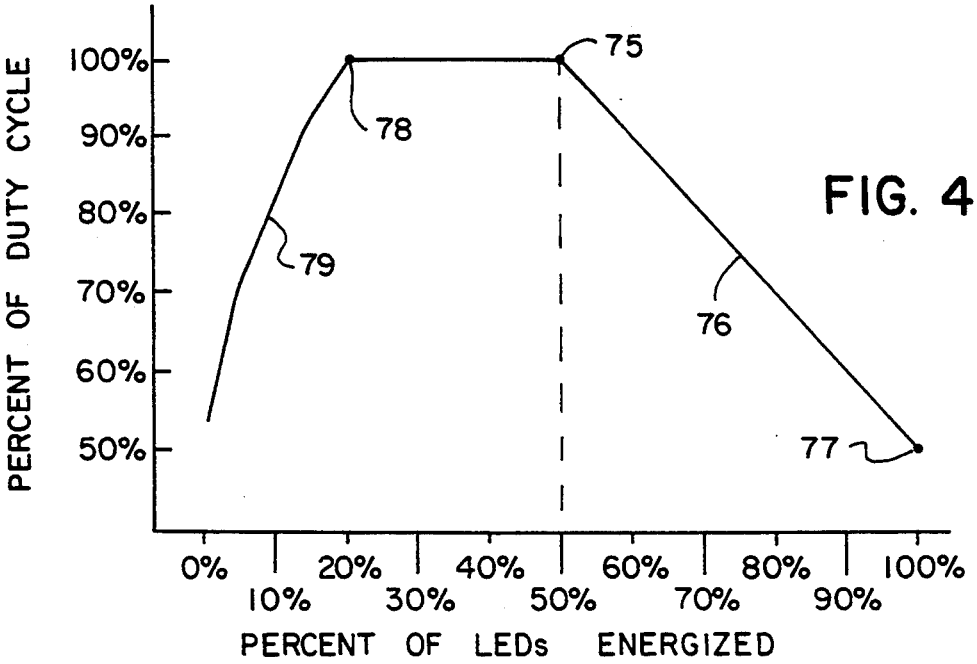
FIG. 4

DISPLAY DRIVER WITH DUTY CYCLE CONTROL

BACKGROUND OF THE INVENTION

The present invention relates to the field of display signs which employ large numbers of individually energized light emitting diodes lights that form the pixels in an image, and more particularly, power supplies for such signs which limit the junction temperature of the light emitting diode.

A display sign which employs a matrix of light emitting diode (LED) lights requires a relatively large power supply to provide the current necessary to energize them. For example, a 7 by 80 matrix of such lights may require 10 amperes at over 5 volts to energize 50% of the lights at any one time at the optimal brightness. This load on the power supply changes dramatically if the image requires the energization of more or fewer lights at any one time, and these load variations will cause swings in the power supply output voltage and current. While the output can be regulated to reduce such voltage and current swings, the additional regulator circuit components increase the power supply cost from 30% to 50%, and this is commercially unacceptable.

Two problems are presented when an unregulated power supply is used to energize an LED display. First, if too many lights are energized at one time, the current limit of the power supply is exceeded and a protective fuse is blown. This can be avoided by increasing the capacity of the power supply, but such a solution is also too expensive, particularly in view of the fact that this extra capacity is rarely needed in typical applications.

At the other extreme, if very few lights are energized simultaneously, the power supply voltage rises and increased current flows through the energized LEDs. This causes a rise in the LED's junction temperature which has been shown to increase their degradation rate, and thus, shorten their useful life. This is a situation that occurs often in images and must be taken into consideration by the power supply designer. One solution is to reduce the maximum current at peak voltages by using a larger series resistor, but this resistor also reduces the brightness of the display to unacceptable levels when large numbers of lights are energized and the power supply voltage drops.

SUMMARY OF THE INVENTION

The present invention relates to a display in which the fluctuations in power supply output are controlled by changing the duty cycle with which the lights are energized as a function of the number of lights energized at any one time. More particularly, the display sign includes means for connecting a power supply to a selected number of lights to energize them for a time interval, means for counting the number of lights to be energized during the time interval, means responsive to the count of lights to be energized to adjust the time interval during which the lights are energized such that the power supply output is maintained within preselected limits.

A general object of the invention is to minimize the cost of a power supply for a display sign without decreasing its brightness. Rather than increasing the capacity of the power supply to handle peak loads or regulating the power supply to limit peak voltage at low loads, the expected load is determined by counting the number of lights to be energized during the next refresh cycle and then adjusting the display refresh duty cycle to regulate the load. The current demand is limited by shortening the duty cycle when large numbers of lights are to be energized at once. While this causes a decrease in the brightness of each light, the overall display brightness does not drop significantly because a larger number of lights are energized.

Another object of the invention is to limit the junction temperature of LED lights by limiting the average current flowing through them. The maximum LED junction temperature is specified by the manufacturer and may be expressed as follows:

$$Tj = Ta + \Delta Tc + \Delta Td$$

where:

Tj = LED junction temperature

Ta = Ambient temperature

ΔTc = temperature rise in case

ΔTd = temperature rise caused by driving LED.

By controlling the display refresh duty cycle as a function of power supply load vs. output voltage characteristics and the LED junction temperature rise vs. peak LED current relationship, the maximum LED junction temperature can be limited.

A more specific object of the invention is to provide a means for controlling the display refresh duty cycle as a complex function of the number of display lights to be energized. The duty cycle is adjusted when the number of energized lights drops to low levels and when it increases to high levels. The desired duty cycle is calculated for a range of numbers and is stored as a duty cycle table. During each display refresh, the number of lights to be energized is counted and used as an input to this table which yields a time value that produces the required duty cycle.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

BRIEF DESCRIPTION OF THE DRAWINGS

FIGS. 2A and 2B are graphs showing the display refresh waveforms employed by the display sign of FIG. 1 at two different duty cycles;

FIG. 4 is a graphic representation of the contents of a duty cycle table which forms part of the display sign of FIG. 1.

DESCRIPTION OF THE PREFERRED EMBODIMENT

Figure 1:
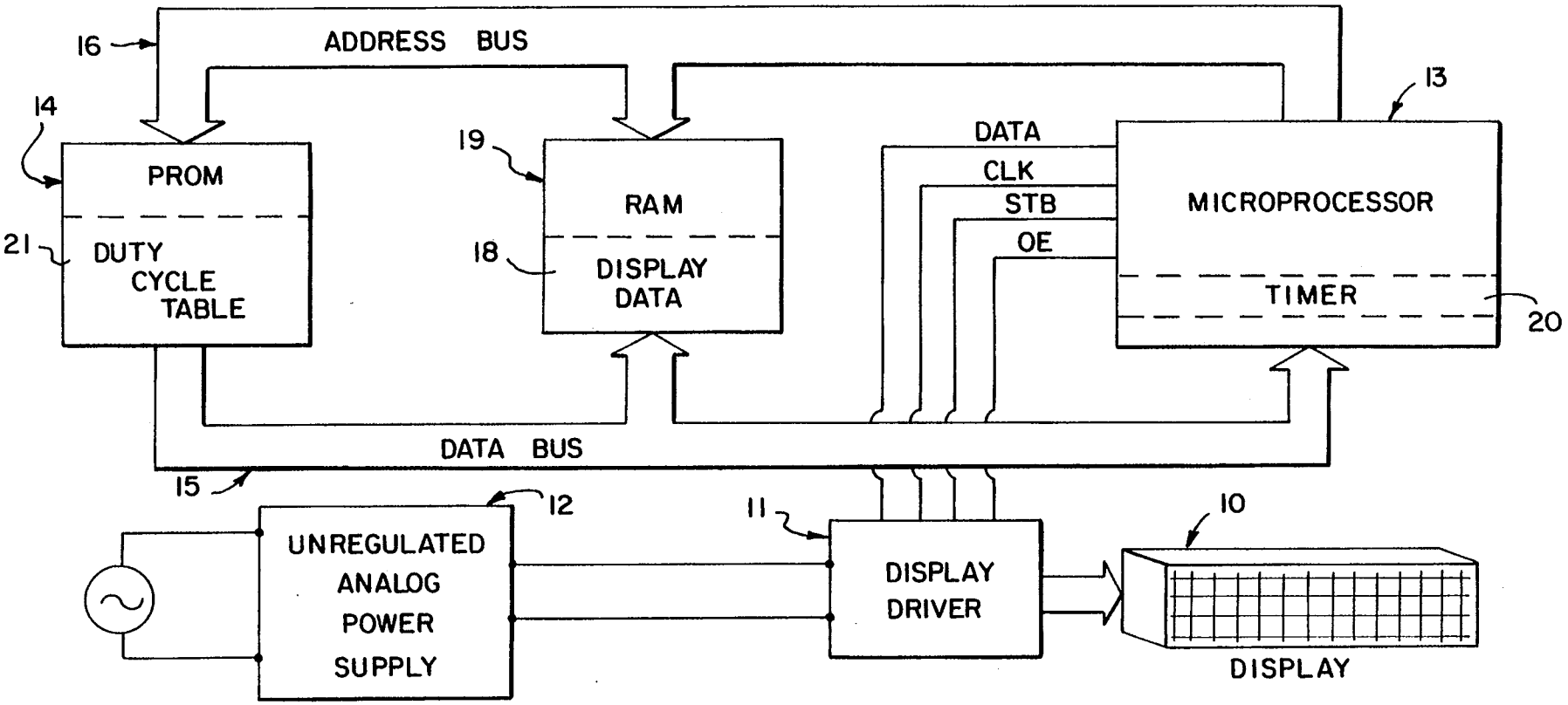
FIG. 1 is an electrical block diagram of a display sign which employs a preferred embodiment of the present invention.

Referring particularly to FIG. 1, a display 10 such as that described in U.S. Pat. Nos. 4,603,496 and 5,043,716 includes a matrix of lights in the form of separately energized LEDs. A display driver 11 connects to the display 10 and is operable to periodically apply a voltage pulse to each LED that is to be energized. The energizing voltage is provided by an unregulated, analog power supply 12, and the display data and display driver control signals are provided by an 8-bit microprocessor 13. The power supply 12 is a conventional power supply for converting AC line voltage to 7.5 volts DC. It has a capacity to produce rated current and voltage when 50% of the LED lights in the display 10 are energized. As the number of energized LEDs increases above this percentage, the power supply voltage drops and total current increases. Absent the present invention, the current limit of the power supply would be exceeded when approximately 50% of the LEDs are energized at once. Conversely, when fewer than 50% of the LEDs are energized, the power supply voltage increases and more current is conducted by the energized LEDs causing their junction temperature to increase. Absent the present invention, the junction temperatures may increase above specified limits and the useful life of the energized LEDs is reduced.

The microprocessor 13 is a model 8031 manufactured by Intel, Inc. It operates in response to a program stored in a programmable read-only memory (PROM) 14 which is read out through an 8-bit data bus 15 in response to address codes produced on an address bus 16. Four lines (DATA, CLK, STB and OE) connect the microprocessor 13 to the display driver 11, and these are driven through one of the microprocessor's output ports. A primary function of the microprocessor 13 is to read display data 18 stored in a random access memory (RAM) 19 and use that display data to selectively energize the LEDs in the display 10. For example, the preferred embodiment of the display 10 is a matrix comprised of 7 rows and 80 columns. As will be described in more detail below, 80 bits corresponding to one row of the display 10 are read from the RAM 19 and shifted serially into the display driver 11 through the DATA line. The STB line indicates to the display driver 11 that display data is being sent, and the 80 bits are shifted into column drivers by signals on the CLK line. A pulse is then produced on the OE (output enable) line which applies the power supply output to those LEDs in the row which are to be energized. This cycle is repeated for each of the 7 rows in the display 10, and at the completion of this "scan", each "pixel" in the display 10 which corresponds to an energized bit in the display data 18 has been energized to produce light. The scan is repeated at such a high "refresh" rate that even though the LEDs are only momentarily energized, they appear continuously energized to the human eye.

A single scan is shown graphically in FIG. 2A, where the OE line is driven in a series of seven logic high enable pulses of duration $t_t$ separated by logic low intervals. During each of the logic low intervals 80 bits of column data for a row are clocked into the display driver 11 as described above, and during the following logic high enable period $t_t$, the indicated LEDs in that row are energized. The time period $t_t$ is the maximum period each LED could be energized during one scan, and it represents a 100% duty cycle. The duty cycle may be reduced, therefore, by simply shortening the logic high enable pulses on the OE line such that each active LED is energized for a shorter time period during each refresh scan. Such a reduced duty cycle is shown in FIG. 2B where the logic high pulses on the OE line have duration $t_d$ which in the example is one half the duration $t_t$ of the 100% duty cycle.

Thus to implement the present invention, no costly hardware is required. One need only alter the waveform produced on the OE line by the microprocessor 13, which is under program control.

The operation of the display driver lines DATA, CLK, STB and OE is determined by a display refresh interrupt routine stored in PROM 14. The microprocessor 13 performs a number of background functions necessary to produce the proper display data 18. However, each time an interval timer 20 "times out", an interrupt is generated which stops all background functions and vectors the microprocessor 13 to the display refresh interrupt routine.

Figure 3:
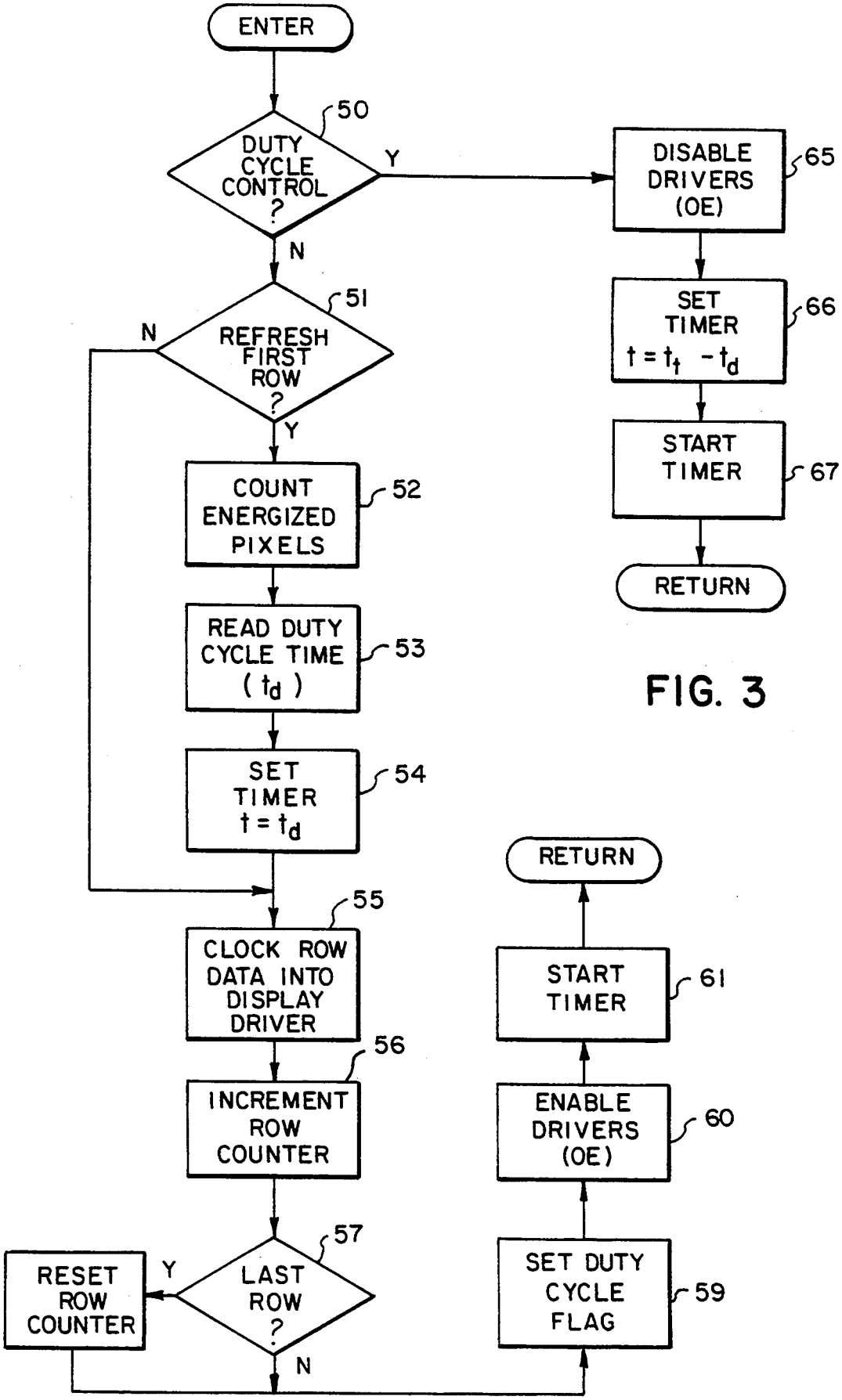
FIG. 3 is a flow chart of a display refresh interrupt routine which is executed by a microprocessor in the display sign of FIG. 1.

Referring particularly to FIG. 3, when the display refresh interrupt routine is executed a duty cycle flag in RAM 19 is examined to determine if this is a duty cycle control interrupt or a refresh display row interrupt. If so, the program branches at decision block 50 as will be described in detail below. Otherwise, a check is made at decision block 51 to determine if a new scan is beginning and the first display row is to be refreshed during this cycle. If so, the display data 18 in RAM 19 is examined as indicated by process block 52 to count the number of pixels that will be energized during this refresh scan to produce the desired image. This count is then used as an index into a duty cycle table 21 stored in PROM 14 and a corresponding duty cycle time ($t_d$) is read therefrom as indicated at process block 53. The interrupt timer 20 is set to this value as indicated at block 54 and a row of display data is read from RAM 10 and clocked out to the display driver 11 as indicated at block 55. A row counter stored in RAM 19 is then incremented at process block 56, and if the last row has been refreshed as determined at decision block 57, the row counter is reset at block 58 so that a new scan will be indicated during the next refresh cycle interrupt. The duty cycle flag is then set at block 59 and the OE line is driven high at process block 60 to energize the LEDs as described above. The timer 20 is then started at block 61, and the system returns from the interrupt.

Referring still to FIG. 3, during the subsequent time interval ($t_d$) the LEDs in one row of the display 10 are energized and draw power from the supply 12. As indicated above, the length of this time period $t_d$ determines the duty cycle, and when the timer 20 times out, the microprocessor 13 is vectored to the interrupt routine which branches at decision block 50 and disables the OE control line at block 65. This terminates the duty cycle by disabling the LED drivers. The timer 20 is then reset to a time ($t_t - t_d$) at process block 66, and the timer is started at process block 67 before returning from the interrupt.

During operation of the display 10, the microprocessor 13, therefore, operates to update the display data 18 stored in RAM 19 and to periodically refresh the display 10 with the display data 18. Prior to each refresh cycle, however, the number of LEDs to be energized is counted and the duty cycle table 21 is used to obtain the duty cycle time $t_d$. This duty cycle time $t_d$ is employed by the display refresh interrupt routine as described above to control the time interval each LED is energized during the subsequent refresh scan.

The duty cycle table 21 stores a set of duty cycle times ($t_d$) which are expressed as "percent of duty cycle" in FIG. 4 and range in value from a 50% duty cycle to a 100% duty cycle. These values are read out as a function of the total number of LEDs to be energized, which is expressed in FIG. 4 as "percent of LEDs energized". As indicated at point 75, the power supply 12 is designed to deliver rated voltage and current at 100% duty cycle when 50% of the LEDs are energized during a refresh cycle. As indicated by the sloped line 76, if more than 50% of the LEDs are to be energized, the duty cycle is proportionately reduced so that the power supply is not overloaded. The duty cycle is reduced to 50% when 100% of the LEDs are energized as indicated at point 77. When the number of energized LEDs drops below 50%, the duty cycle remains at 100% until the power supply voltage rises to the point where the energized LED's junction temperature will exceed the manufacturer's specification due to excess current. This occurs at point 78 in the preferred embodiment, when approximately 22% of the LEDs are energized. Below this operating point the duty cycle is sharply reduced as indicated by curve 79.

The precise point 78 at which the duty cycle is curtailed to prevent overheating, and the shape of the curve 79 is determined by the power supply voltage rise that will produce an LED junction temperature rise ΔTd that is not to be exceeded. The maximum junction temperature is expressed as follows:

$$T_j = T_a + \Delta T_c + \Delta T_d$$

where:

$T_j$=maximum rated junction temperature $T_a$=display sign ambient temperature $T_c$=temperature rise due to display sign enclosure $\Delta T_d$=temperature rise due to LED current.

The duty cycle values represented by the curve 79 are calculated such that as the power supply voltage increases with decreasing load, the following LED temperature rise due to LED current is not exceeded:

$$\Delta T_d = T_j - T_a - \Delta T_c$$

The calculated duty cycle times ($t_d$) are stored in the duty cycle table 21 in PROM 14.

I claim:

1. A display sign, the combination comprising:

a display having a plurality of lights which are separately energized to produce an image;

a power supply for producing electrical power to energize said lights;

a display driver for energizing selective ones of the lights in the display by cyclically applying electrical power from the power supply to the lights to be energized during a duty cycle;

a processor for indicating to the display driver which lights are to be energized and for controlling the duration of said duty cycle, the processor including:

a) means for determining the number of lights to be energized; and b) means responsive to the number of lights to be energized for determining said duty cycle, whereby the duty cycle is reduced when the number of lights to be energized drops below a determined number as a function of the number of lights to be energized.

2. The display sign as recited in claim 1 in which the means for determining said duty cycle also reduces the duty cycle when the number of lights to be energized increases above a second determined number as a function of the number of lights to be energized.

3. The display sign as recited in claim 1 in which the means for determining said duty cycle includes a stored duty cycle table containing values which indicate duty cycle as a function of the number of lights to be energized.

4. The display sign as recited in claim 3 in which the display lights to be energized are indicated by display data stored in a memory and the processor cyclically couples said display data to the display driver to control which lights are to be energized, and the means for determining the number of lights to be energized examines said stored display data.

5. The display sign as recited in claim 4 in which the processor is a programmed microprocessor coupled to said stored duty cycle table and said stored display data.

6. The display sign as recited in claim 1 in which the lights are light emitting diodes and the duty cycle is reduced such that the temperature rise in each energized light emitting diode due to current flow during said duty cycle does not exceed a predetermined amount.

7. The display sign as recited in claim 2 in which the means for determining said duty cycle reduces the duty cycle when the lights to be energized increases above said second determined number by an amount which limits the total electrical power produced by said power supply to a predetermined maximum power.

* * * * *